United States Patent [19]

Eager

[11] 4,029,387

[45] June 14, 1977

[54] ELECTRIC LAMP BASE AND METHOD OF ASSEMBLY

[76] Inventor: John W. Eager, 51 Dale Drive, Chatham, N.J. 07928

[22] Filed: Nov. 24, 1975

[21] Appl. No.: 634,354

[52] U.S. Cl. ..... 339/146; 313/318

[51] Int. Cl.[2] ..... H01J 5/60

[58] Field of Search ..... 313/318; 339/140 R, 339/145 R, 146; 29/25.13

[56] References Cited

FOREIGN PATENTS OR APPLICATIONS

| | | | |
|---|---|---|---|
| 535,000 | 12/1956 | Canada | 339/146 |
| 731,010 | 1/1943 | Germany | 339/146 |
| 15,769 | 8/1901 | United Kingdom | 313/318 |

*Primary Examiner*—Roy Lake
*Assistant Examiner*—E. F. Desmond
*Attorney, Agent, or Firm*—Lane, Aitken, Dunner & Ziems

[57] ABSTRACT

A base assembly and method for electric incandescent lamps in which a preformed base insulator and contact eyelet are assembled with a conventional base shell by threading the insulator and contact eyelet as a subassembly into the shell. Provision is made for retaining the insulator and the metallic shell against unthreading rotation either by a direct binding of portions of the insulator and the shell or by serrating the inner edge of an in-turned flange on the shell in a manner to allow threading rotation of the insulator and shell but to prevent unthreading rotation of these parts.

7 Claims, 5 Drawing Figures

FIG. 1.
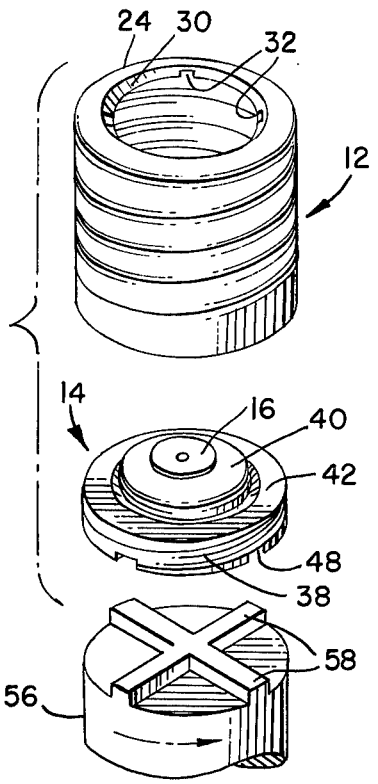
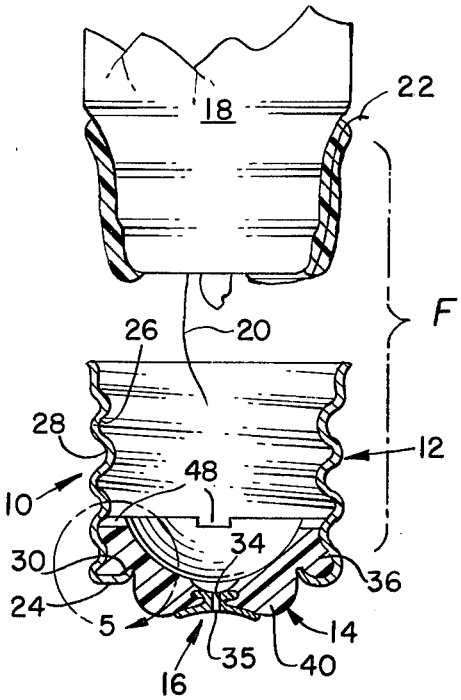
FIG. 2.
FIG. 3.
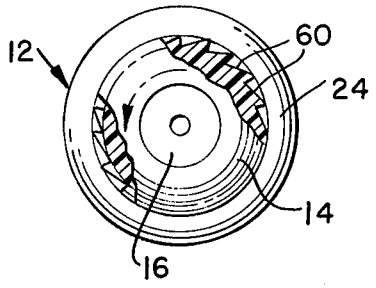
FIG. 4.
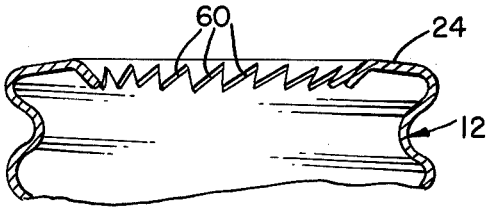
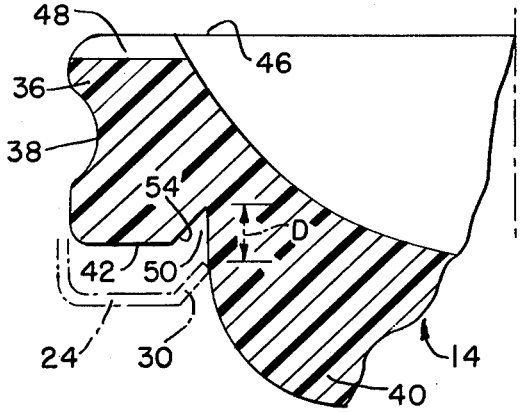
FIG. 5.

ELECTRIC LAMP BASE AND METHOD OF ASSEMBLY

BACKGROUND OF THE INVENTION

This invention relates to bases for electric lamps and other threaded electrical connecting devices. More particularly, it concerns an improved base assembly for incandescent lamps by which the functional characteristics and aesthetic appearance of such bases is materially enhanced and also which contributes to reduced manufacturing costs as compared with those of lamp bases most commonly used at present.

Currently, bases for most commercially available incandescent electric lamps take the form of a threaded metal shell open at one end for receipt of the sealed glass envelope or bulb and having at its other end a glass insulator securing the assembly of one or more contact eyelets with the metal shell. The bases are manufactured as components for subsequent lamp-basing operations by placing the metal shell and eyelet(s) in a suitably contoured die, feeding a gob of molten glass into the die and molding the glass to a shape which encompasses portions of both the shell and the contact eyelet or eyelets if more than one is used.

Molding the glass insulator in situ is desirable from the standpoint of providing an integrated base structure but poses numerous problems, which though not apparent to the consuming public, are recognized as longstanding and essentially unsolved by the electric lamp industry. For example, the high temperatures at which the glass must be maintained for molding is undesirable in the base manufacturing operation both from the standpoint of high cost fuel consumption required to maintain the glass in a molten or moldable state and from the standpoint of deleterious effects on the metal components of the base. In this latter respect, heat transferred from the molten gob of glass weakens the metal by annealing to such an extent that shells are frequently deformed merely by required handling in transfer to lamp making machines. Also the heat discolors the metal so as to require chemical cleaning and brightening operations. In addition, imperfections in the molded glass insulators, such as voids resulting from an inadequate supply of glass or cracking and chipping of the glass either during molding or subsequent handling combine with the aforementioned difficulties to result in a high rejection rate either of the bases at the time of attachment to the lamp or of the lamps as a result of defective bases in the exercise of quality control.

Recognition of the problems associated with in situ molding of glass in the forming of lamp bases is evidenced in the prior patent art by U.S. Pat. No. 2,336,529 issued Dec. 14, 1943 to P. O. Cartun and U.S. Pat. No. 3,775,634 issued Nov. 27, 1973 to Richard F. Hasell et al. as well as by the references cited in the texts of these patents. As further evidenced by the disclosures of these patents, solutions proposed heretofore have involved generally a redesign of the metal base shell to achieve a mechanical interlock between the shell and a preformed insulator. Also, the mechanical interconnection is predicated either by machined deformation of the metal shell or on elasticity of a shell portion in the nature of a spring clip or tang to retain the assembly of the insulator and the shell. It is believed that these alternative approaches to the use of in situ glass molding have been found unacceptable to the industry either because of costs or because of failure to achieve the required integration of base structure components. Irrespective of the reasons, the continued use of in situ glass molding of the lamp base insulator by the industry in spite of the recognized deficiencies with this manufacturing technique makes it clear that the alternatives represented by prior disclosures are less than completely satisfactory.

SUMMARY OF THE PRESENT INVENTION

In accordance with the present invention, the problems heretofore encountered in the manufacture and assembly of lamp bases having glass insulators molded in situ are sustantially overcome by threading a preformed insulator into a standard base shell so as to bind the insulator rigidly in the cell and thus unitize the base assembly. The insulator may be any of several acceptable synthetic resins and is preferably molded about a portion of a terminal eyelet so that the eyelet and the insulator as a unit are threadably assembled with the sleeve. The configuration of the plastic insulator parallels the configuration of the glass insulator currently in use and as such is defined by a circular rim portion having a concentric protruding portion to which the eyelet is connected, the protruding portion defining with the rim an annular abutment surface to engage and bind with a turned-in flange formation conventionally found on the end of the threaded shells opposite the end thereof in which the sealed glass envelope is inserted. The radial end surface of the rim portion opposite the annular abutment surface is provided with torque transmission means such as slots by which driving torque imparted to a rotatable tool may be used to thread the insulator into the shell. One-way serrations or teeth may be formed in the in-turned flange of the shell to augment prevention of unthreading rotation of the insulator relative to the shell.

Among the objects of the present invention are therefore: the provision of a novel lamp base assembly by which the physical characteristics and aesthetic appearance are materially enhanced as compared with lamp bases presently in use; the provision of such an improved and novel lamp base by which manufacturing costs may be reduced by comparison with the current state of the art; the provision of such a lamp base resulting in an improved mechanical connection between a preformed insulator and a conventional threaded metallic shell; the provision of such a lamp base in which use of presently available component parts is maximized; and the provision of a novel method for the manufacture of bases for incandescent lamps and the like.

Other objects and further scope of applicability of the present invention will become apparent from the detailed description to follow taken in conjunction with the drawings in which like reference numerals designate like parts.

BRIEF DESCRIPTION OF THE DRAWINGS

FIG. 1 is an exploded perspective view illustrating the components of the present invention prior to assembly together with a tool used for the assembly;

FIG. 2 is a fragmentary and exploded cross-sectional view depicting attachment of a sealed lamp envelope to the improved lamp base of the present invention;

FIG. 3 is a bottom plan view illustrating an alternative embodiment of the present invention;

FIG. 4 is an enlarged fragmentary cross-section illustrating the details of the embodiment of FIG. 3; and FIG. 5 is a greatly enlarged fragmentary cross-section of the area circumscribed by line 5 in FIG. 2.

DETAILED DESCRIPTION OF THE PREFERRED EMBODIMENTS

In FIG. 2 of the drawing, the lamp base of the present invention is generally designated by the reference numeral 10 and shown to include as components a threaded metal shell 12, an insulator 14 and a contact eyelet 16. Although the invention is concerned primarily with the fabrication and structural organization of the base 10, use of the base is predicated on its attachment to a sealed glass envelope 18 of an incandescent lamp having a pair of wire leads 20 and 22. Such attachment of the envelope 18 to the base 10 is conventional and as such, entails insertion and cementing of the envelope 18 into the upper or open-ended portion of the shell 12 with the lead 20 passing through the eyelet 16 and the lead 22 passing over the upper edge of the shell 12. The leads are subsequently soldered to the shell and eyelet, respectively.

In the embodiment of FIGS. 1 and 2 of the drawings, metal shell 12 is identical in all respects with shells currently used in bases having in lieu of the insulator 14 of the present invention, an in situ molded glass insulator as described above. As such, the metal shell is in the form of a thin-walled cylinder having an inwardly directed flange 24 at one end and screw threads extending from that end toward the other open end into which the bulb or sealed envelope 18 is inserted. The threads are conventionally rolled or otherwise formed by inward deformation of the shell wall so as to establish complementing inner and outer threads 26 and 28 respectively in the wall of the shell 12. Also it will be noted that the flange 24, as shown most clearly in FIG. 1, is provided with an inner edge 30 having notches 32 presumably for the purpose of enhancing the connection of the shell to the molded glass insulator of the prior art. The edge 30 is inclined toward the open end of the shell to establish a frustro-conical surface of a slope approximating 45° to the shell axis. Also the metal from which the shell 12 is conventionally formed may be brass or aluminum approximately 0.015 inches thick although this thickness may vary depending on the overall size of the shell and thus of the lamp base to be used.

In accordance with the present invention, the insulator 14 is formed of high temperature phenolic resins or other suitable plastic materials, non-conducting glass, mica or asbestos filled material capable of being molded or preformed as a subassembly with the eyelet 16. In this latter respect, it is noted that the eyelet 16, in itself, is conventional and as such includes a flared tubular post portion 34 to be embedded in the material of the insulator 14 and also to establish an aperture 35 through which the lead 20 of the bulb 18 is passed during assembly of the bulb 18 with the base 10 as above mentioned.

The precise configuration of the preformed or molded insulator 14 may be appreciated by reference to FIGS. 1, 2 and 5 of the drawings. In particular, the insulator is formed to establish a circular rim portion 36 having on its peripheral surface at least one and preferably one and one-half threads 38 adapted to engage the internal threads 26 of the metal shell 12. A protruding bulbous end portion 40 is concentric with the rim portion 36 and is of a maximum diameter in the region where it connects to the rib portion, such maximum diameter being smaller than the ouside diameter of the rim portion 36 to establish an annular abutment surface 42 to engage the inner surface of the flange 24 on the shell 12. The surface of the insulator opposite the protruding bulbous portion 40 and the abutment surface 42 is established in substantial part by a concentric hemispherical cavity 44 which opens at an annular face 46. The annular face 46 is provided with four radial slots 48 to facilitate the transmission of driving torque to rotate the insulator relative to the shell during assembly herewith and in a manner to be described in more detail below.

An important feature of the invention and particularly in the configuration of the insulator 14 is a provision made for binding the insulator against unthreading rotation thereof relative to the shell 12. In this respect, and as shown in FIG. 5 of the drawings, the region of juncture between the bulbous protruding portion 40 and the annular abutment surface 42 is formed with a tapered or V-shaped groove 50 defined on one side by a cylindrical surface 52 of a length represented by the dimension D and on its other side by a conical or inclined surface 54. The angle of convergence of the surfaces 52 and 54 is approximately 45° and as such, will complement the angle at which the in-turned edge 30 of the shell 12 is inclined with respect to the flange 24 thereof. As a result, the inclined inner edge 30 of the flange 24 will be captured or bound in the convergent groove 50 on the insulator. This binding action is augmented further by a selection of a diameter for the cylindrical surface 52 (the maximum diameter of the bulbous portion 40) to be essentially the same as the inside diameter of the inclined inner edge 30 of the flange 24.

In the manufacture of the improved base 10 of this invention, the subassembly of the insulator 14 and the eyelet 16 will be first formed by an injection molding operation of a type well-known in the art. This subassembly of the eyelet and the insulator is then assembled with the shell 12 in a production line (not shwon) including a station at which a driving tool 56 is provided. As shown in FIG. 1 of the drawings, the driving tool 56 includes projecting radial teeth 58 which are oriented to engage the radial slots 48 in the insulator 14. Because of the provision of four equiangular slots and radial teeth, positioning of the insulator 14 on the tool 56 will be facilitated. Thereafter, the tool 56 is rotated relative to the shell 12 to drive the preformed insulator 14 against the inwardly extending flange 30 to the position illustrated in FIG. 2 of the drawings.

The facility for locating the insulator 14 concentrically on the tool 56 can be served by other torque transmitting means and by a number of teeth and slots other than four. For example, three or more driving teeth 58 and a corresponding number of slots 48 will achieve similar results.

It will be appreciated that because the threaded connection of the insulator 14 in the shell 12 will involve a direction of threading rotation the same as the direction of threading employed to rotate the finished bulb into a socket, for example, it is important that no unthreading rotation of the insulator relative to the shell occur as a result of such rotation of the lamp and the shell 12 while frictional forces during the terminal portion of the lamp insertion would tend to hold the insulator stationary. The binding action effected by the groove 50 and the inclined edge 30 of the shell flange 24 prevents such forces from effecting an unthreading of the insulator in the base.

The binding action referred to above with respect to the embodiments of FIGS. 1 and 2 can be further augmented by an alternative embodiment illustrated in FIGS. 3 and 4. In particular, ratchet-like or one-way serrations 60 may be provided on the edge 30 of the shell flange 24. The serrations are shaped so that threaded insertion of the insulator 14 to a point where the abutment surface 42 engages firmly against the flange 24 will be unaffected. Unthreading rotation of the insulator relative to the shell, however, will be prevented by the tangs 60 engaging the pointed extremity of the groove 50.

Thus it will be seen that by this invention there is provided a highly improved lamp base and method for its manufacture by which the aforementioned objectives are completely fulfilled. It is contemplated that various modifications and/or changes may be made in the embodiments disclosed herein and that such modifications and/or changes will be apparent to those skilled in the art. It is expressly intended, therefore, that the foregoing description is illustrative of preferred embodiments only, not limiting, and that the true spirit and scope of the present invention be determined by reference to the appended claims.

I claim:

1. A base assembly for electric lamp and the like comprising:

a thin-walled cylindrical shell having an inwardly directed flange at one end and screw threads extending from said one end toward the other end thereof, said flange having an inner edge portion inclined toward the other end of said shell, said threads being formed by inward deformation of the shell wall thereby to establish complementing inner and outer threads in said shell;

a preformed insulator having a threaded rim portion engagable with said inner shell thread, a protruding portion concentric with said rim portion, an annular abutment surface between said protruding and rim portions, the juncture of said protruding portion and said annular abutment surface being formed with an annular groove to receive said inner edge portion of said flange, thereby to capture said edge portion in a manner to bind said insulator against unthreading relative to said shell, and means for transmitting driving torque to said rim portion on a face thereof opposite from said annular surface; and contact means secured to said protruding portion and spaced from shell.

2. The apparatus recited in claim 1 wherein one side of said groove is defined by a cylindrical surface of a diameter the same as a maximum diameter of said protruding portion and essentially the same as the inside diameter of said inclined inner edge portion.

3. The apparatus recited in claim 1 wherein said inner edge portion is serrated to prevent unthreading rotation of said insulator relative to said shell.

4. The apparatus recited in claim 1 wherein said driving torque transmitting means comprises three or more equiangularly spaced radial slots.

5. The apparatus recited in claim 1 wherein said insulator is molded from synthetic resinous material.

6. The apparatus recited in claim 5 wherein said insulator is molded to said contact means.

7. In an electric lamp base assembly including a conventional thin-walled cylindrical shell having an inwardly directed flange at one end and screw threads extending from the one end toward the other end thereof, the threads being formed by inward deformation of the shell wall to establish complementing inner and outer threads, the inwardly directed flange having an inner edge portion inclined toward the other end of the shell, the improvement comprising:

a preformed insulator having a threaded rim portion engagable with the inner shell threads, a protruding portion concentric with said rim portion, an annular abutment surface between said protruding and rim portions, the juncture of said protruding portion and said annular abutment surface being formed with an annular groove to receive the inner edge portion of the shell flange, thereby to enable the insulator to be threaded against the shell flange sufficiently to be bound against unthreading relative rotation of the shell and said insulator, means for the transmission of driving torque to said rim portion on a face thereof opposite from said annular surface and contact means secured to the end of said protruding portion to be spaced by said insulator from the shell.

* * * * *